US007480467B2

(12) United States Patent
Ueki et al.

(10) Patent No.: US 7,480,467 B2
(45) Date of Patent: Jan. 20, 2009

(54) IMAGE FORMATION APPARATUS AND METHOD THEREFOR

(75) Inventors: Masaki Ueki, Niigata (JP); Osamu Fujinawa, Niigata (JP)

(73) Assignee: Fuji Xerox Co., Ltd., Tokyo (JP)

( * ) Notice: Subject to any disclaimer, the term of this patent is extended or adjusted under 35 U.S.C. 154(b) by 243 days.

(21) Appl. No.: 11/476,708

(22) Filed: Jun. 29, 2006

(65) Prior Publication Data

US 2007/0183796 A1 Aug. 9, 2007

(30) Foreign Application Priority Data

Feb. 20, 2006 (JP) ..... 2006-042498

(51) Int. Cl.
*G03G 15/00* (2006.01)

(52) U.S. Cl. ..... 399/23; 271/9.01; 271/9.02; 271/9.03; 271/9.04; 271/9.05; 399/391

(58) Field of Classification Search ..... 399/23, 399/391; 271/9.01, 9.02, 9.03, 9.04, 9.05
See application file for complete search history.

(56) References Cited

U.S. PATENT DOCUMENTS 6,526,253 B2 * 2/2003 Hayashi et al. ..... 399/391
2006/0119029 A1 * 6/2006 Kitamura ..... 271/275

FOREIGN PATENT DOCUMENTS

| | | |
|---|---|---|
| JP | 5-92831 | 4/1993 |
| JP | 2838132 | 10/1998 |
| JP | 2003-312871 | 11/2003 |

* cited by examiner

*Primary Examiner*—Ren Yan
*Assistant Examiner*—Andy L Pham
(74) *Attorney, Agent, or Firm*—Sughrue Mion, PLLC

(57) ABSTRACT

An image formation apparatus that includes plural paper feed trays, and when there occurs out-of-paper in a paper feed tray during printing, changes over from the paper feed tray to another to continue the printing, which includes a detection section that detects that paper is added in the paper feed tray, a memory that stores paper feed trays for which the detection section detects that paper is added therein in the sequence of paper being added; and a paper feed tray changing section that, when there occurs out-of-paper in a paper feed tray in operation during printing, selects a paper feed tray in which paper is added in the earliest time among the paper feed trays which are stored in the memory, and changes over the paper feed tray.

6 Claims, 8 Drawing Sheets

IMAGE FORMATION APPARATUS AND METHOD THEREFOR

BACKGROUND OF THE INVENTION

1. Field of the Invention

The present invention relates to an image formation apparatus which has a function of relay paper feeding that, when there occurs out-of-paper in a paper feed tray, selects another paper feed tray for paper feeding to continue the printing, and a method therefor, and particularly relates to an image formation apparatus which, at the time of paper feed tray selection in the relay paper feeding, selects the paper feed tray having the earliest date of paper addition to continue the printing, thus preventing old paper from being left over at the bottom of the paper feed tray, and a method therefor.

2. Description of the Related Art

In the field of printing, if an instruction for producing a large number of copies as a printing job is given, the image formation apparatus which is a printing apparatus requires a large quantity of paper in order to produce the specified number of copies.

However, the number of pieces of paper that can be accommodated in the paper feed tray in an image formation apparatus is limited, and thus when, during printing, there occurs out-of-paper in the paper feed tray in service, paper had to be manually added in the emptied paper feed tray for resuming the printing.

Then, in order to address the time-consuming problem that paper has to be manually added, Japanese Patent Application Laid-Open No. 5-92831 has proposed a cut-paper printer which includes two paper feed trays, and when out-of-paper has been detected in one paper feed tray, automatically changes over paper feed tray in operation to another one, whereby the need for interrupting the printing due to out-of-paper is eliminated.

However, in the relay paper feeding, in which, after out-of-paper having been caused in a paper feed tray, another paper feed tray is used for paper feeding, the sequence of changing over paper feed tray is fixed, and in order to prevent out-of-paper from being caused, paper is added to the paper feed tray for use in the subsequent paper feeding, thus there has occurred a problem that, at the bottom of a paper feed tray, old paper which has long been not used is left over.

In order to address the problem that old paper is left over, Japanese Patent Application Laid-Open No. 2003-312871 has proposed a printer with which the date of paper accommodation is recorded on the paper feed tray as information about paper, and in accordance with the priority of use that has been set for the paper feed trays on the basis of the date of paper accommodation, the paper feed tray is selected for printing, such that no old paper is left over.

In addition, Japanese Patent No. 2838132 has proposed a facsimile apparatus which is configured to feed paper from the bottom of the paper tray for printing such that no old paper is left over.

Thus, inventions which prevent old paper from being left over at the bottom of the paper feed tray have been proposed, however, the invention of Japanese Patent Application Laid-Open No. 2003-312871 has presented a problem that, in order to store the information about the date of paper accommodation, there is the need for incorporating a clock equipped with a backup power supply, resulting in the cost being increased.

In addition, with the invention of Japanese Patent No. 2838132, a new mechanism for feeding paper from the bottom is required, and this mechanism is not popular, which has presented quality and cost problems.

SUMMARY OF THE INVENTION

Therefore, the present invention has been made in view of the above circumstances and provides an image formation apparatus which can prevent old paper from being left over at the bottom of the paper feed tray, thus addressing the quality and cost problems, and at the time of paper feed tray selection in the relay paper feeding, can select the paper feed tray having the earliest date of paper accommodation for continuing the printing, thus preventing old paper from being left over at the bottom of any paper feed tray, and a method therefor.

Then, an aspect of the invention provides an image formation apparatus that includes plural paper feed trays, and when there occurs out-of-paper in a paper feed tray during printing, changes over from the paper feed tray to another to continue the printing, which includes a detection section that detects that paper is added in the paper feed tray, a memory that stores paper feed trays for which the detection section detects that paper is added therein in the sequence of paper being added; and a paper feed tray changing section that, when there occurs out-of-paper in a paper feed tray in operation during printing, selects a paper feed tray in which paper is added in the earliest time among the paper feed trays which are stored in the memory, and changes over the paper feed tray.

An another aspect of the invention provides an image formation method for an image formation apparatus that includes plural paper feed trays, and when there occurs out-of-paper in a paper feed tray during printing, changes over from the paper feed tray to another to continue the printing, which includes detecting, by a detection section, that paper is added in the paper feed tray, storing, by a memory, paper feed trays for which the detection section detects that paper is added therein in the sequence of paper being added; and when there occurs out-of-paper in a paper feed tray in operation during printing, selecting, by a paper feed tray changing section, the paper feed tray in which paper is added in the earliest time among the paper feed trays which are stored in the memory, and changing over the paper feed tray.

BRIEF DESCRIPTION OF THE DRAWINGS

Embodiments of the present invention will be described in detail based on the following figures, wherein.

DETAILED DESCRIPTION OF THE INVENTION

Hereinbelow, an image formation apparatus and a method therefor pertaining to embodiments of the present invention will be described in detail with reference to the attached drawings.

First Embodiment

Figure 1:
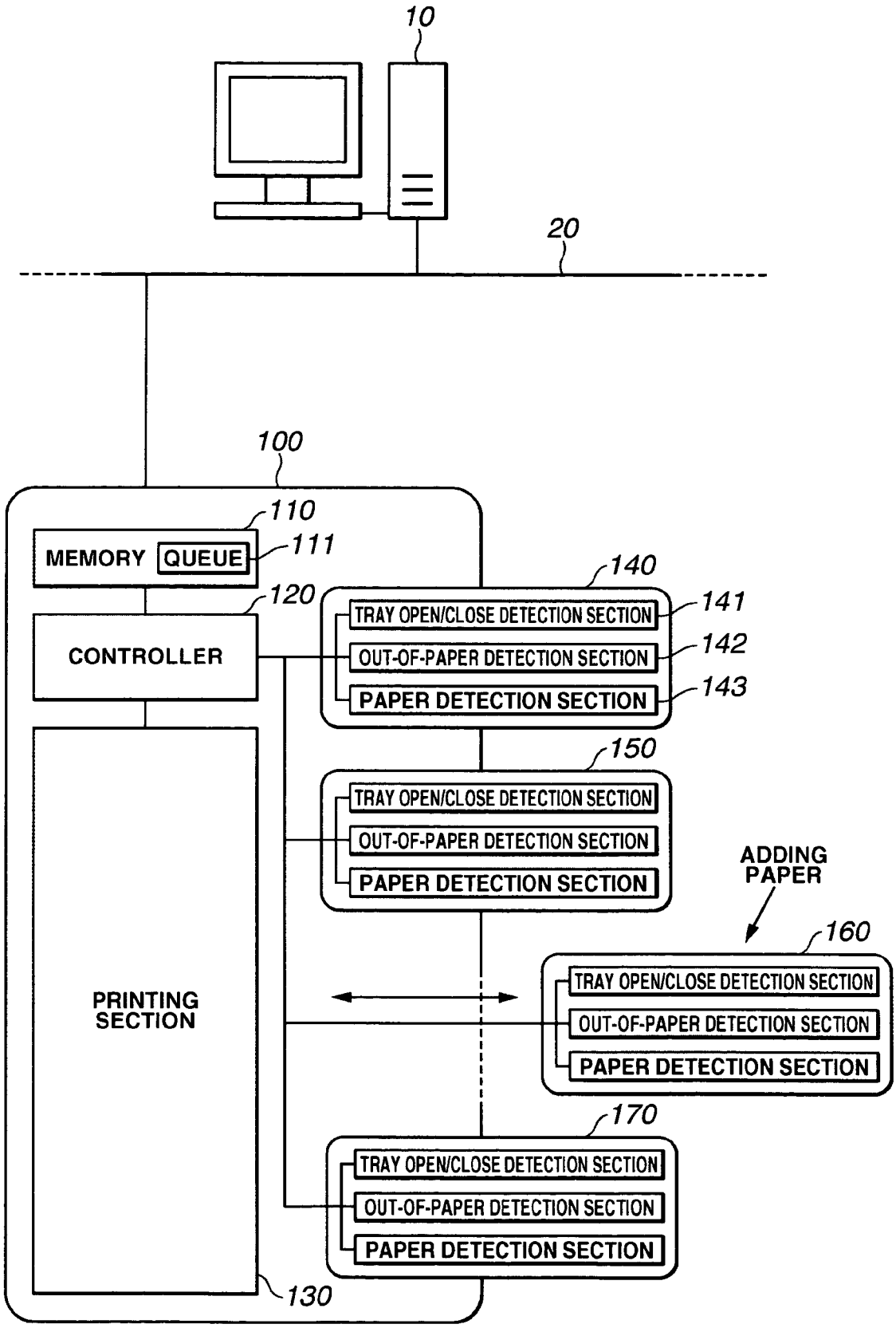
FIG. 1 is a block diagram of an image formation apparatus 100 and a system configuration diagram of a system constituted by the image formation apparatus 100.

FIG. 1 is a block diagram illustrating the internal configuration of an image formation apparatus 100 pertaining to the present invention and a system configuration diagram of a system constituted by the image formation apparatus 100.

As shown in FIG. 1, the system constituted by the image formation apparatus 100 pertaining to the present invention is configured in the form in which a personal computer 10 and the image formation apparatus 100 are connected through a network 20.

The personal computer 10 sends a printing job to the image formation apparatus 100 through the network 20.

In addition, the image formation apparatus 100 includes a memory 110, a controller 120, a printing section 130, a paper feed tray (paper feed tray A) 140, a paper feed tray (paper feed tray B) 150, a paper feed tray (paper feed tray C) 160, and a paper feed tray (paper feed tray D) 170.

The memory 110 is constituted by a non-volatile memory, and therewithin, includes a queue for reserving printing jobs awaiting printing in the printing section 130, and a queue 111 for selecting the paper feed tray at the time of relay paper feeding.

The controller 120 comprehensively controls the image formation apparatus 100; detects that paper is added in the paper feed tray; and when, during printing, the paper feed tray in operation causes out-of-paper, the relay paper feeding being to be performed, selects the paper feed tray for the subsequent paper feeding to make paper feed tray changeover.

The printing section 130 carries out printing using paper in the paper feed tray on the basis of the printing job sent from the personal computer 10.

The paper feed tray (paper feed tray A) 140 stocks pieces of paper to be used by the printing section 130, including a tray open/close detection section 141, an out-of-paper detection section 142, and a paper detection section 143.

In addition, the tray open/close detection section 141 in the paper feed tray (paper feed tray A) 140 functions at the time when the paper feed tray (paper feed tray A) 140 is opened from the state in which it is set in the image formation apparatus 100, in order to accommodate pieces of paper therein, and at the time when the paper feed tray (paper feed tray A) 140 which has been opened with pieces of paper having been accommodated therein is closed to be set in the image formation apparatus 100.

In addition, the out-of-paper detection section 142 in the paper feed tray (paper feed tray A) 140 detects the state in which the pieces of paper in the paper feed tray (paper feed tray A) 140 have been used up during printing.

In addition, the paper detection section 143 in the paper feed tray (paper feed tray A) 140 detects the existence of paper in the paper feed tray (paper feed tray A) 140.

The plural paper feed trays provided in the image formation apparatus 100, i.e., the paper feed tray (paper feed tray A) 140, the paper feed tray (paper feed tray B) 150, the paper feed tray (paper feed tray C) 160, and the paper feed tray (paper feed tray D) 170 all have the same construction, including the tray open/close detection section, the out-of-paper detection section, and the paper detection section of the same construction.

And, when, after the out-of-paper detection section 142 in the paper feed tray (paper feed tray A) 140 having detected out-of-paper in the paper feed tray (paper feed tray A) 140, the tray open/close detection section 141 detects that the paper feed tray (paper feed tray A) 140 has been opened; thereafter, the tray open/close detection section 141 detects that the paper feed tray (paper feed tray A) 140 has been closed; thereafter, the paper detection section 143 detects the existence of paper in the paper feed tray (paper feed tray A) 140, the controller 120 determines that the paper feed tray (paper feed tray A) 140 which has caused out-of-paper has been opened; paper has been accommodated therein; and then it has been closed into the image formation apparatus 100, registering the paper feed tray (paper feed tray A) 140 in the queue 111 implemented in the memory 110.

With the image formation apparatus 100 thus configured, when there occurs out-of-paper, which means that the pieces of paper in the paper feed tray in operation is used up during printing, the relay paper feeding, which changes over paper feed tray to be used for paper feeding, is carried out to continue the printing.

When the relay paper feeding is carried out, the paper feed tray registered the earliest in the queue 111 implemented in the memory 110 is selected as the paper feed tray for the subsequent paper feeding.

Next, the structure of the queue 111 implemented in the memory 110 that is used in selection of a paper feed tray in the relay paper feeding will be described with reference to FIG. 2.

Figure 2:
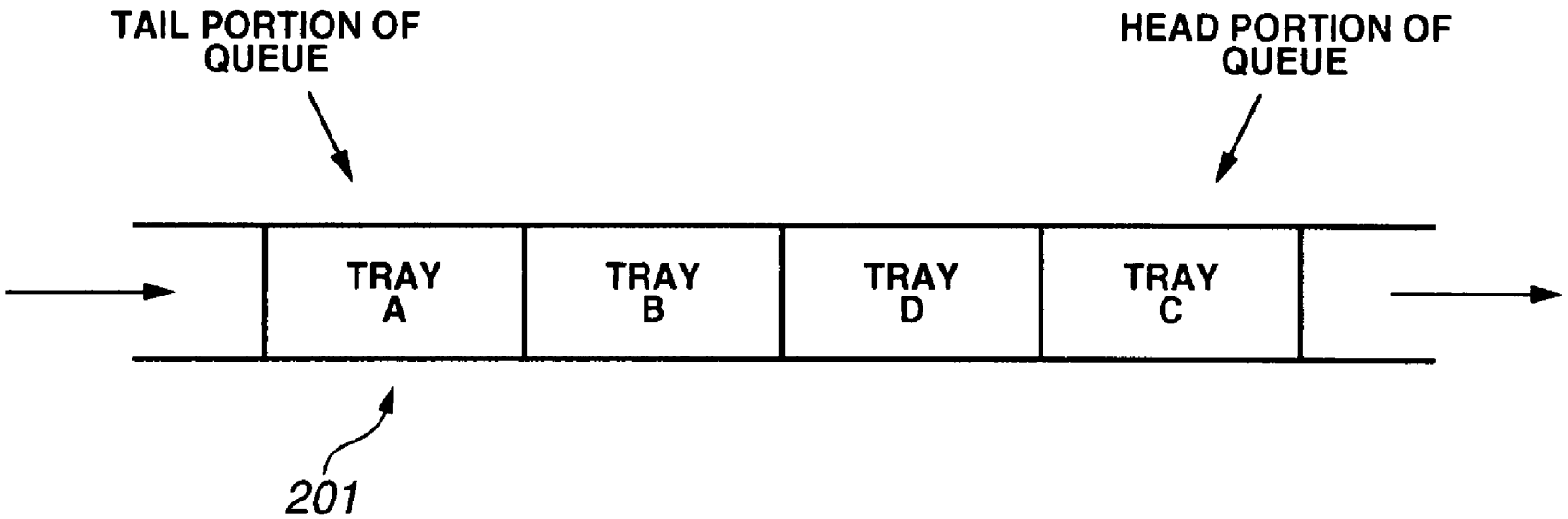
FIG. 2 is a conceptual diagram illustrating the image of a queue 111.

FIG. 2 is a conceptual diagram illustrating the image of the queue 111 implemented in the memory 110 that is used in selection of a paper feed tray.

For example, when, in the state in which paper is being fed from the paper feed tray (paper feed tray A) 140 for printing, the paper feed tray (paper feed tray A) 140 causes out-of-paper, the out-of-paper detection section 142 in the paper feed tray (paper feed tray A) 140 detects the out-of-paper.

And, the paper feed tray (paper feed tray A) 140 is opened out of the image formation apparatus 100; paper is accommodated in the empty paper feed tray (paper feed tray A) 140; and the paper feed tray (paper feed tray A) 140 in which paper is added is closed to be set in the image formation apparatus 100.

In that case, when the paper feed tray (paper feed tray A) 140 is opened out of the image formation apparatus 100, it is detected by the tray open/close detection section 141; when the paper feed tray (paper feed tray A) 140 is closed into the image formation apparatus 100, it is detected by the tray open/close detection section 141; and then the existence of paper in the paper feed tray (paper feed tray A) 140 is detected by the paper detection section 143.

Thus, when out-of-paper is detected by the out-of-paper detection section 142; the opening and closing of the tray is detected by the tray open/close detection section 141; and the existence of paper is detected by the paper detection section 143, the paper feed tray (paper feed tray A) 140 is then registered in the tail part of the queue 111 in the memory 110.

As shown in FIG. 2, in the queue 111 indicating the sequence of the paper feed tray to be selected in the relay paper feeding, the tray A denoting the paper feed tray (paper feed tray A) 140 is given at the tail of the sequence (reference No. 201).

In the queue 111 as shown in FIG. 2, the time series sequence of the paper feed trays which causes out-of-paper and in which paper is added provides a sequence of the paper feed tray (paper feed tray C) 160, the paper feed tray (paper feed tray D) 170, the paper feed tray (paper feed tray B) 150, and the paper feed tray (paper feed tray A) 140, starting from the earliest registered one, and when the subsequent relay paper feeding is carried out with a paper feed tray being selected, the paper feed tray (paper feed tray C) 160, which identification number is given at the head of the queue 111, causing out-of-paper and paper being added therein in the earliest, is selected for continuing the printing.

In this manner, the queue 111 for selection of the paper feed tray is implemented in the memory 110, thus when the relay paper feeding is carried out, paper feed tray selection is performed, starting from the paper feed tray in which paper is added in the earliest, which eliminates the possibility of occurrence of a paper feed tray in which old paper is left over at the bottom.

Next, the processing of registering a paper feed tray in which paper is added in the queue 111 which is implemented in the memory 110 will be described with reference to FIG. 3.

Figure 3:
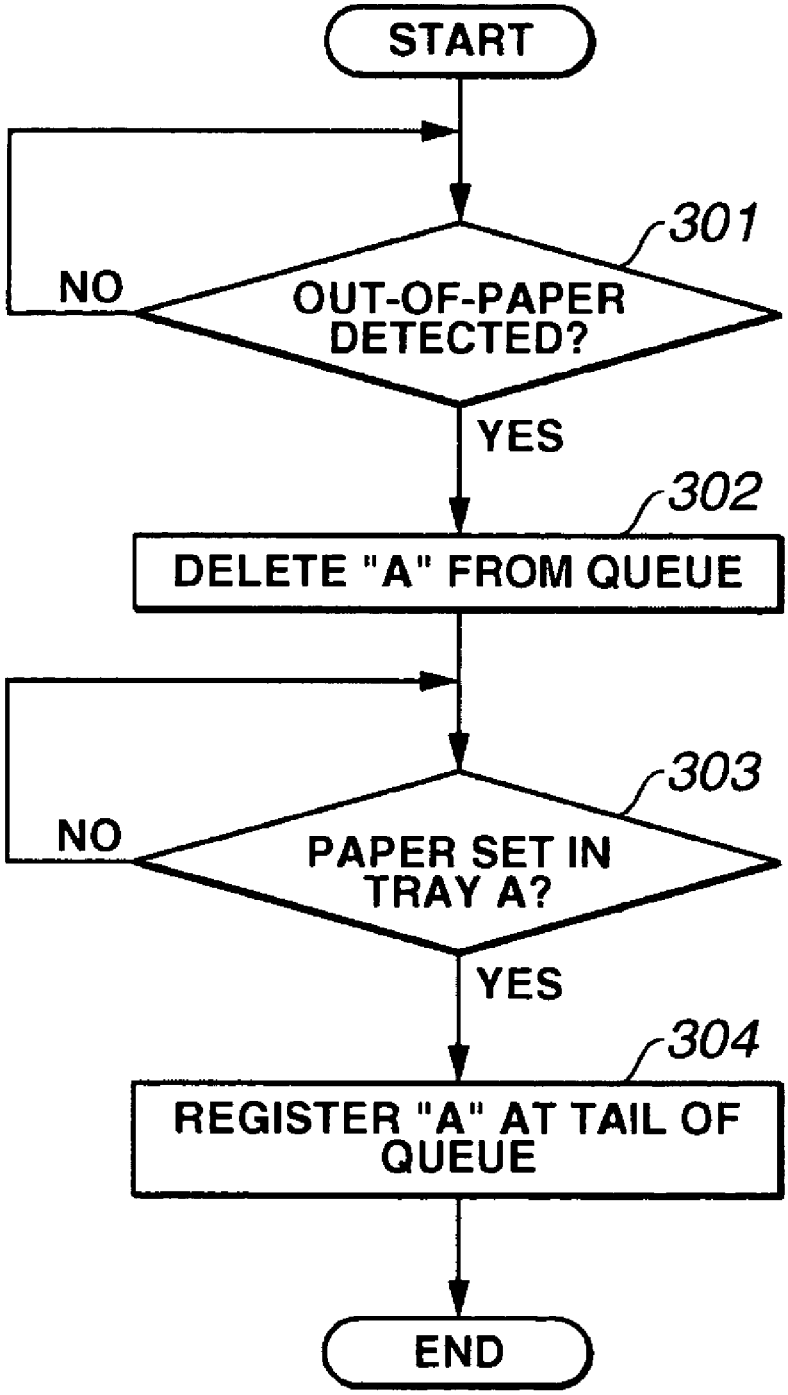
FIG. 3 is a flowchart illustrating the processing of registering the identification number of a paper feed tray in the queue 111.

FIG. 3 is a flowchart illustrating the processing of registering a paper feed tray in the queue 111 for paper feed tray selection in the memory 110 in the image formation apparatus 100.

Of the plural paper feed trays provided for the image formation apparatus 100, let's take the paper feed tray (paper feed tray A) 140 as an example for explanation.

In the image formation apparatus 100, when the out-of-paper detection section 142 in the paper feed tray (paper feed tray A) 140 detects out-of-paper (YES at step 301), "A", which is the identification number of the paper feed tray (paper feed tray A) 140 including the out-of-paper detection section 142, is deleted from the queue 111 (step 302).

And, when the tray open/close detection section 141 for the tray identification number "A", which has been deleted, detects that the paper feed tray (paper feed tray A) 140 has been opened and closed, and the paper detection section 143 detects the existence of paper, it is determined by the controller 120 that paper has been accommodated in the paper feed tray (paper feed tray A) 140 to be set in the image formation apparatus 100 (YES at step 303).

Then, "A", which is the identification number of the paper feed tray (paper feed tray A) 140 provided with the tray open/close detection section 141, which has detected that the tray has been closed, is registered at the tail of the queue 111 in the memory 110 by the controller 120 (step 304).

Thus, the paper feed tray which causes out-of-paper and in which paper is added is registered at the tail of the queue 111.

The paper feed tray which is registered at the tail of the queue 111 may be not only the current paper feed tray or the paper feed tray which is just being used for printing, but also an optional paper feed tray.

Next, the processing which is performed in paper feed tray selection at the time of the relay paper feeding with the image formation apparatus 100 will be described with reference to FIG. 4.

Figure 4:
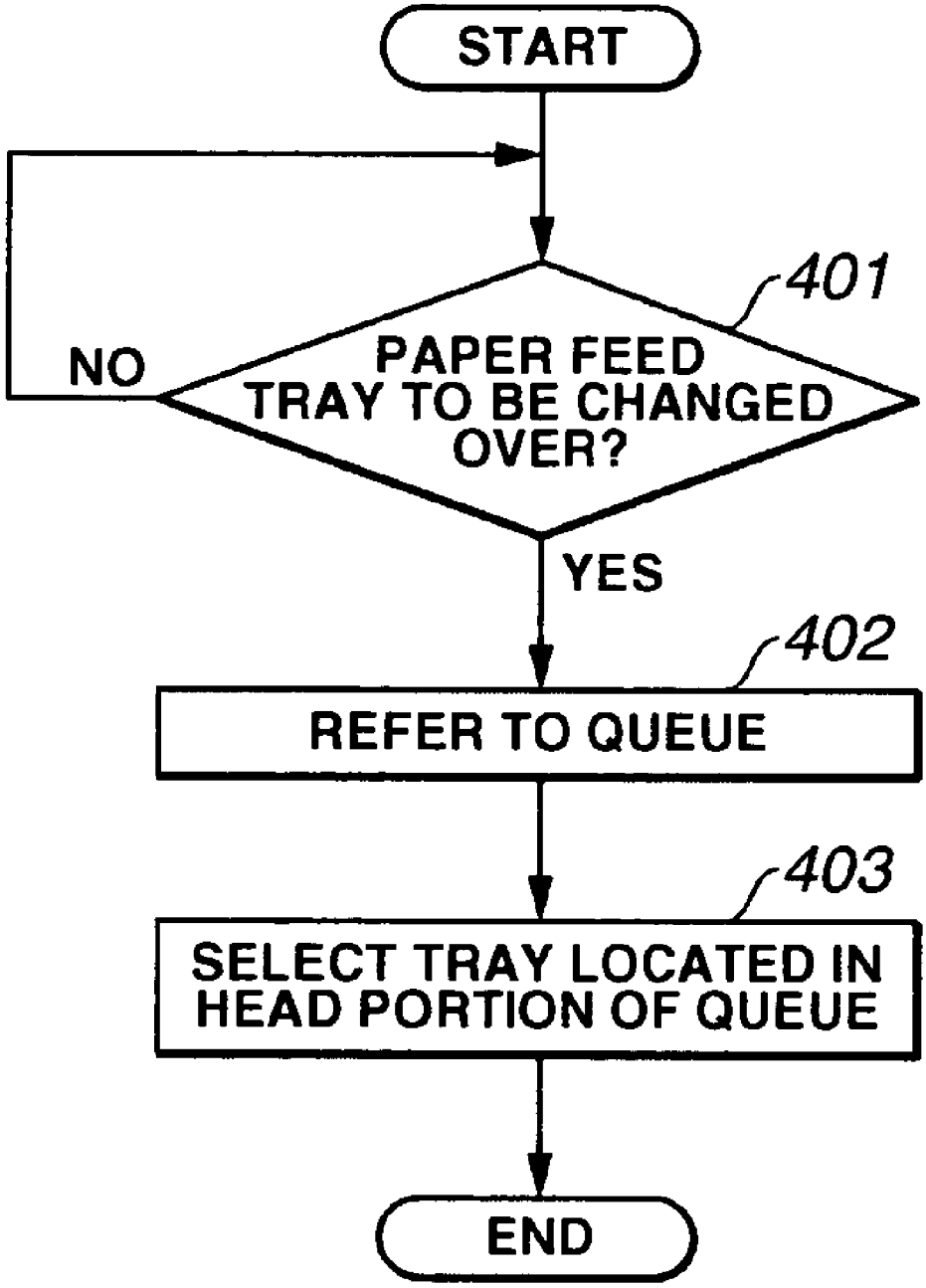
FIG. 4 is a flowchart illustrating the processing of selecting a paper feed tray by referencing the queue 111.

FIG. 4 is a flowchart illustrating the processing which is performed in paper feed tray selection at the time of the relay paper feeding with the image formation apparatus 100.

When the image formation apparatus 100 is performing printing, and the paper feed tray in operation causes out-of-paper, there arises the need for selecting the paper feed tray which is to perform the subsequent paper feeding, in order to continue the printing by carrying out paper feeding from another paper feed tray (YES at step 401).

When there arises the need for changing over paper feed tray (YES at step 401), the controller 120 references the queue 111 implemented in the memory 110 (step 402).

The controller 120 references the queue 111, and selects the paper feed tray of the identification number given at the head of the queue 111, excluding the identification number of the paper feed tray in which out-of-paper occurs (step 403).

Then, with the paper feeding being performed by the paper feed tray selected by the controller 120, the printing is performed with no interruption.

Thus, in the relay paper feeding, the controller 120 references the queue 111 after out-of-paper occurring; selects the subsequent paper feed tray; and the paper feeding is performed from the selected paper feed tray, the printing being continued.

In addition, by using a memory, the relay paper feeding, which selects the paper feed tray such that no old paper is left over, can be made with no cost problem being presented.

Second Embodiment

In the first embodiment, as the requirements for the identification number of a paper feed tray being registered in the queue, out-of-paper in the paper feed tray being detected; the paper feed tray being opened out of the image formation apparatus and thereafter being closed being detected; and the existence of paper being detected have been mentioned, however, in the present embodiment, as the requirements for the identification number of a paper feed tray being registered in the queue, the same requirements as those in the first embodiment, excluding out-of-paper in the paper feed tray being detected and the existence of paper being detected, are used.

In other words, in the present embodiment, the requirements for the identification number of a paper feed tray being registered in the queue are the paper feed tray being opened out of the image formation apparatus and thereafter being closed being detected, which provides the requirements on the assumption of an event that paper is to be added to a paper feed tray.

First, an image formation apparatus and a system configuration pertaining to the present invention will be described with reference to FIG. 5.

Figure 5:
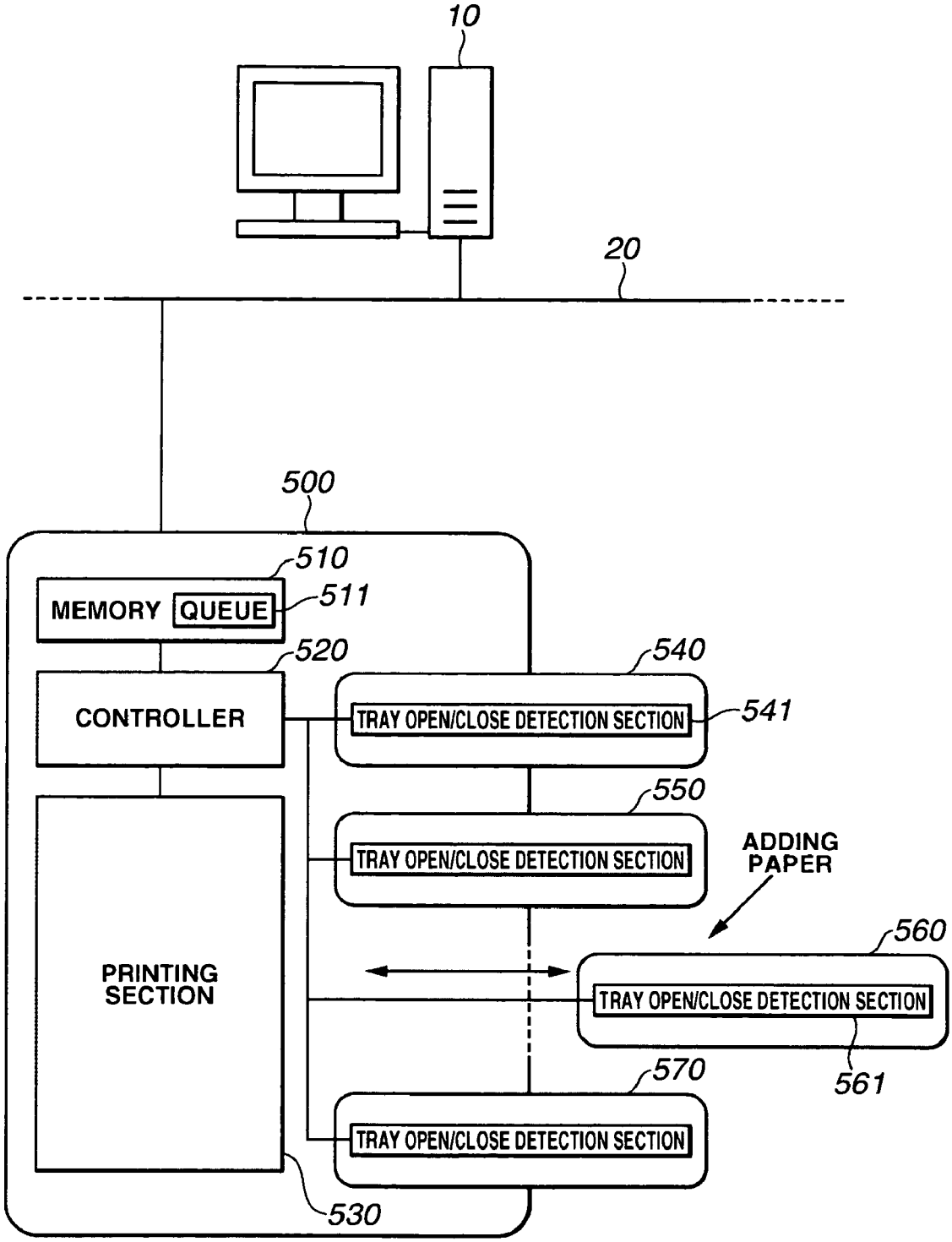
FIG. 5 is a block diagram of an image formation apparatus 500 and a system configuration diagram of a system constituted by the image formation apparatus 500.

FIG. 5 is a block diagram illustrating the internal configuration of an image formation apparatus 500 pertaining to the present invention and a system configuration diagram of a system constituted by the image formation apparatus 500.

As shown in FIG. 5, the image formation apparatus 500 and a personal computer 10 are connected to each other through a network 20.

The personal computer 10 sends a printing job to the image formation apparatus 500 through the network 20.

In addition, the image formation apparatus 500 is capable of printing the printing job received from the personal computer 10, and as shown in FIG. 5, includes a memory 510, a controller 520, a printing section 530, a paper feed tray (paper feed tray A) 540, a paper feed tray (paper feed tray B) 550, a paper feed tray (paper feed tray C) 560, and a paper feed tray (paper feed tray D) 570.

The memory 510 is constituted by a non-volatile memory, and within the memory 510, includes a queue for reserving printing jobs awaiting printing in the printing section 530, and a queue 511 for selecting the paper feed tray at the time of relay paper feeding.

The controller 520 comprehensively controls the image formation apparatus 500; detects a paper feed tray in which paper is added; and when, during printing, the paper feed tray in operation causes out-of-paper, the relay paper feeding being to be performed, selects the paper feed tray for the subsequent paper feeding to make paper feed tray changeover.

The printing section 530 carries out printing using paper in the paper feed tray on the basis of the printing job sent from the personal computer 10.

The paper feed tray (paper feed tray A) 540 stocks pieces of paper to be used by the printing section 530, including a tray open/close detection section 541.

In addition, the tray open/close detection section 541 in the paper feed tray (paper feed tray A) 540 functions at the time when the paper feed tray (paper feed tray A) 540 is opened from the state in which it is set in the image formation apparatus 500, in order to add pieces of paper therein, and at the time when the paper feed tray (paper feed tray A) 540 which is opened with pieces of paper being added therein is closed to be set in the image formation apparatus 500.

The plural paper feed trays provided in the image formation apparatus 500, i.e., the paper feed tray (paper feed tray A) 540, the paper feed tray (paper feed tray B) 550, the paper feed tray (paper feed tray C) 560, and the paper feed tray (paper feed tray D) 570 all have the same construction, including the tray open/close detection section of the same construction.

And, when, in order to add paper, the paper feed tray (paper feed tray A) 540 is opened and paper is added, and then the paper feed tray (paper feed tray A) 540 is closed and set in the image formation apparatus 500, the tray open/close detection section 541 in the paper feed tray (paper feed tray A) 540 detects that the paper feed tray (paper feed tray A) 540 is opened out of the image formation apparatus 500 and closed, thus when such detection is made, the controller 520 determines that paper is added in the paper feed tray (paper feed tray A) 540, registering the identification number of the paper feed tray (paper feed tray A) 540 in the queue 511 for selection of a paper feed tray.

The image of the queue 511 is the same as that of the queue 111, which is explained in the first embodiment with reference to FIG. 2, thus in the present embodiment, the explanation thereof is omitted (however, the queue 111 and the queue 511 differ from each other in the requirements to be met for a paper feed tray to be registered in the queue).

With the image formation apparatus 500 thus configured, when there occurs out-of-paper, which means that the pieces of paper in the paper feed tray in operation is used up during printing, the relay paper feeding, which changes over paper feed tray to be used for paper feeding, is carried out to continue the printing.

When the relay paper feeding is carried out, the paper feed tray registered the earliest in the queue 511 implemented in the memory 510 is selected as the paper feed tray for the subsequent paper feeding.

Next, the processing of registering the identification number of the paper feed tray which is opened and closed in the queue 511 in the image formation apparatus 500 win be described with reference to FIG. 6.

Figure 6:
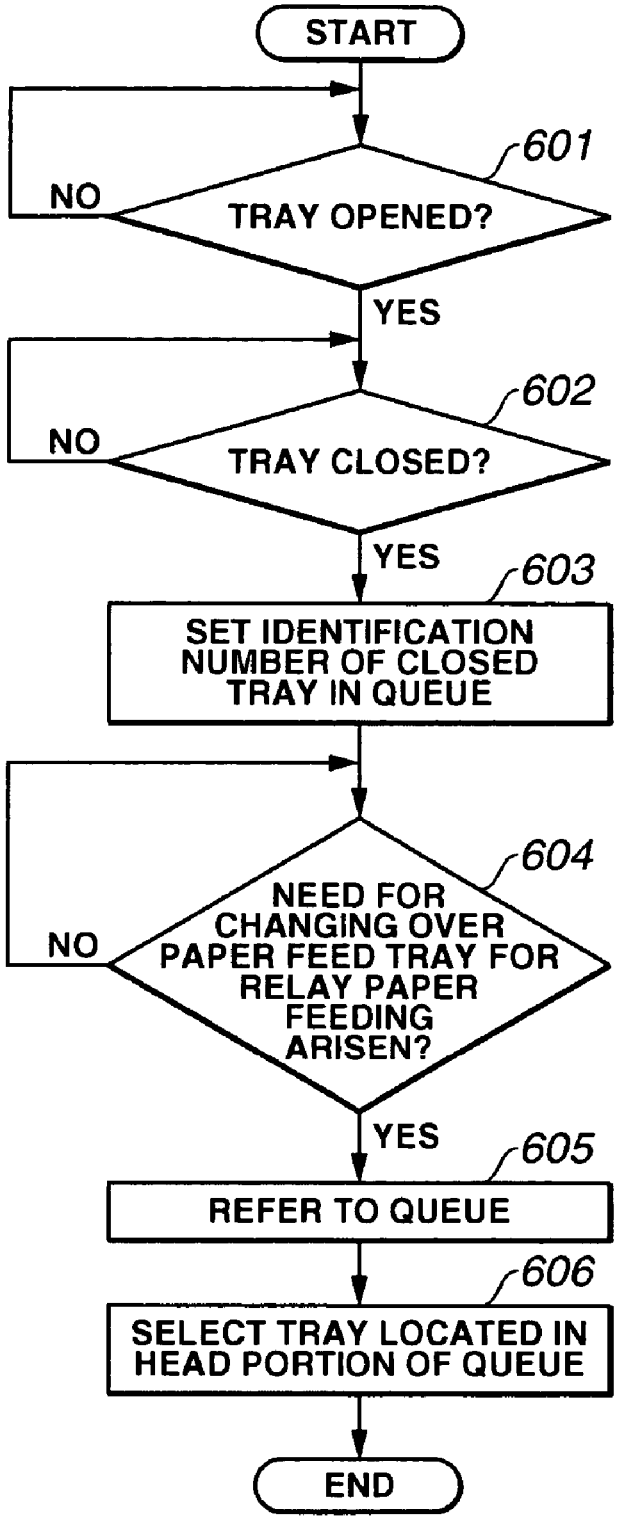
FIG. 6 is a flowchart illustrating the processing of registering the identification number of a paper feed tray in the queue 511.

FIG. 6 is a flowchart illustrating the processing of registering the identification number of the paper feed tray which is opened and closed in the queue 511 in the image formation apparatus 500.

Of the plural paper feed trays provided for the image formation apparatus 500, let's take the paper feed tray (paper feed tray C) 560 as an example for explanation.

When the paper feed tray (paper feed tray C) 560 in the image formation apparatus 500 is opened out of the image formation apparatus 500 in which its has been set, the tray open/close detection section 561 in the paper feed tray (paper feed tray C) 560 detects that the tray has been opened (YES at step 601).

And, in the opened paper feed tray (paper feed tray C) 560, paper is added.

When the paper feed tray (paper feed tray C) 560 in which paper is added is closed to be set in the image formation apparatus 500, the tray open/close detection section 561 in the paper feed tray (paper feed tray C) 560 detects that the paper feed tray (paper feed tray C) 560 is closed (YES at step 602).

Then, because the paper feed tray (paper feed tray C) 560 has been opened and closed, the controller 520 determines that, in the paper feed tray (paper feed tray C) 560, paper is added, and registers "C", which is the identification number of the paper feed tray (paper feed tray C) 560, in the queue 511 implemented in the memory 510.

The registration in the queue 511 implemented in the memory 510 is performed by first deleting "C", which is the identification number to be registered, from the queue 511, and registering "C" at the tail of the queue 511 (step 603).

And, when, during printing, out-of-paper is caused, and there arises the need for changing over paper feed tray for the relay paper feeding (YES at step 604), the controller 520 references the queue 511 implemented in the memory 510 (step 605), and selects the paper feed tray of the identification number at the head of the queue 511, excluding the identification number of the paper feed tray which causes the out-of-paper, as the paper feed tray for the subsequent paper feeding (step 606).

And, by the selected paper feed tray, in which paper is accommodated in the earliest time, paper feeding is performed to continue the printing.

Unlike the first embodiment, in the present embodiment, the requirements to be met for a paper feed tray to be registered in the queue exclude the detection of out-of-paper in the paper feed tray, and a paper feed tray in which paper is added is registered in the queue, thus the paper feed tray in which paper is added the earliest can be first used.

The paper feed tray which is registered at the tail of the queue 511 may be not only the current paper feed tray or the paper feed tray which is just being used for printing, but also an optional paper feed tray which is selected by the user.

Third Embodiment

In the first embodiment, as the requirements for the identification number of a paper feed tray being registered in the queue, out-of-paper in the paper feed tray being detected; the paper feed tray being opened out of the image formation apparatus and thereafter being closed being detected; and the existence of paper being detected is mentioned; and in the second embodiment, as the requirements for the same, the paper feed tray being opened out of the image formation apparatus and thereafter closed being detected is mentioned; however, in the present embodiment, as the requirements for the identification number of a paper feed tray being registered in the queue, the paper feed tray being opened out of the image formation apparatus and thereafter closed being detected by the tray open/close detection section, and at that time, the quantity of the paper in the paper feed tray is increased before the opening being detected by the paper residual quantity detection section are used.

First, an image formation apparatus and a system configuration pertaining to the present invention will be described with reference to FIG. 7.

Figure 7:
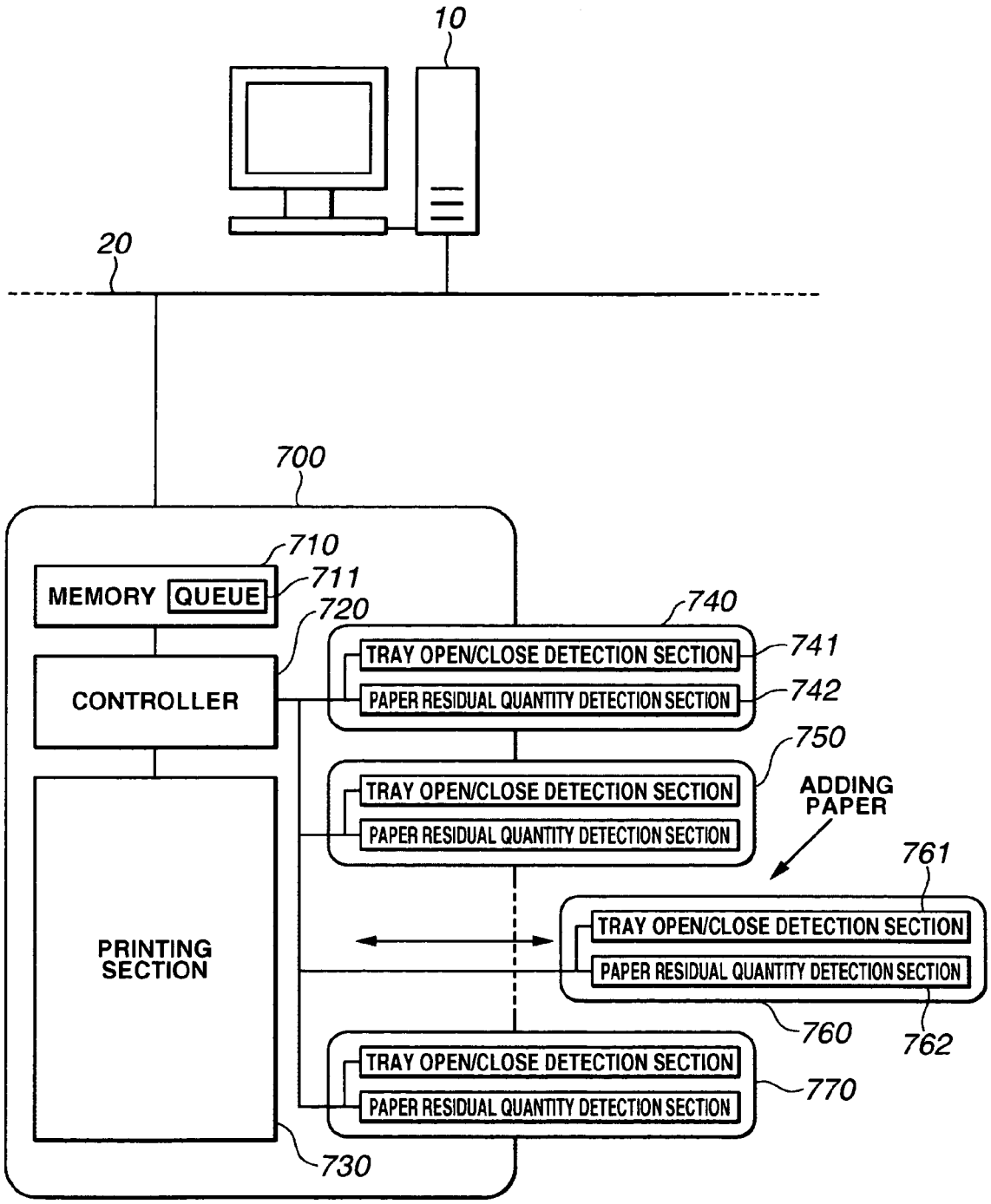
FIG. 7 is a block diagram of an image formation apparatus 700 and a system configuration diagram of a system constituted by the image formation apparatus 700.

FIG. 7 is a block diagram illustrating the internal configuration of an image formation apparatus 700 pertaining to the present invention and a system configuration diagram of a system constituted by the image formation apparatus 700.

As shown in FIG. 7, the image formation apparatus 700 and a personal computer 10 are connected to each other through a network 20.

The personal computer 10 sends a printing job to the image formation apparatus 700 through the network 20.

In addition, the image formation apparatus 700 is capable of printing the printing job received from the personal computer 10, and as shown in FIG. 7, includes a memory 710, a controller 720, a printing section 730, a paper feed tray (paper feed tray A) 740, a paper feed tray (paper feed tray B) 750, a paper feed tray (paper feed tray C) 760, and a paper feed tray (paper feed tray D) 770.

The memory 710 is constituted by a non-volatile memory, and within the memory 710, includes a queue for reserving printing jobs awaiting printing in the printing section 730, and a queue 711 for selecting the paper feed tray at the time of relay paper feeding.

The controller 720 comprehensively controls the image formation apparatus 700; detects a paper feed tray in which paper is added; and when, during printing, the paper feed tray in operation causes out-of-paper, the relay paper feeding being to be performed, selects the paper feed tray for the subsequent paper feeding to make paper feed tray changeover.

The printing section 730 carries out printing using paper in the paper feed tray on the basis of the printing job sent from the personal computer 10.

The paper feed tray (paper feed tray A) 740 stocks pieces of paper to be used by the printing section 730, including a tray open/close detection section 741 and a paper residual quantity detection section 742.

In addition, the tray open/close detection section 741 in the paper feed tray (paper feed tray A) 740 functions at the time when the paper feed tray (paper feed tray A) 740 is opened from the state in which it is set in the image formation apparatus 700, and at the time when the paper feed tray (paper feed tray A) 740 which is opened is closed to be set in the image formation apparatus 700.

The paper residual quantity detection section 742 can detect the residual quantity of the paper in the paper feed tray (paper feed tray A) 740.

The plural paper feed trays provided in the image formation apparatus 700, i.e., the paper feed tray (paper feed tray A) 740, the paper feed tray (paper feed tray B) 750, the paper feed tray (paper feed tray C) 760, and the paper feed tray (paper feed tray D) 770 all have the same construction, including the tray open/close detection section and the paper residual quantity detection section of the same construction.

And, when, in order to add paper, the paper feed tray (paper feed tray A) 740 is opened and paper is added, and then the paper feed tray (paper feed tray A) 740 is closed and set in the image formation apparatus 700, the tray open/close detection section 741 in the paper feed tray (paper feed tray A) 740 detects that the paper feed tray (paper feed tray A) 740 has been opened out of the image formation apparatus 700 and closed, and when the controller 720 verifies that the paper residual quantity detection section 742 detects an increase in paper residual quantity in the paper feed tray (paper feed tray A) 740 after the opening, as compared to the quantity before the opening, the controller 720 determines that paper is added in the paper feed tray (paper feed tray A) 740, registering "A", which is the identification number of the paper feed tray (paper feed tray A) 740, in the queue 711 in the memory 710.

The image of the queue 711 is the same as that of the queue 111, which is explained in the first embodiment with reference to FIG. 2, thus in the present embodiment, the explanation thereof is omitted (however, the queue 111 and the queue 711 differ from each other in the requirements to be met for a paper feed tray to be registered in the queue).

With the image formation apparatus 700 thus configured, when there occurs out-of-paper, which means that the pieces of paper in the paper feed tray in operation is used up during printing, the relay paper feeding, which changes over paper feed tray to be used for paper feeding, is carried out to continue the printing.

When the relay paper feeding is carried out, the paper feed tray registered the earliest in the queue 711 implemented in the memory 710 is selected as the paper feed tray for the subsequent paper feeding.

Next, the processing of registering the identification number of the paper feed tray which is opened, in which paper is added, and which is closed in the queue 711 in the image formation apparatus 700 will be described with reference to FIG. 8.

Figure 8:
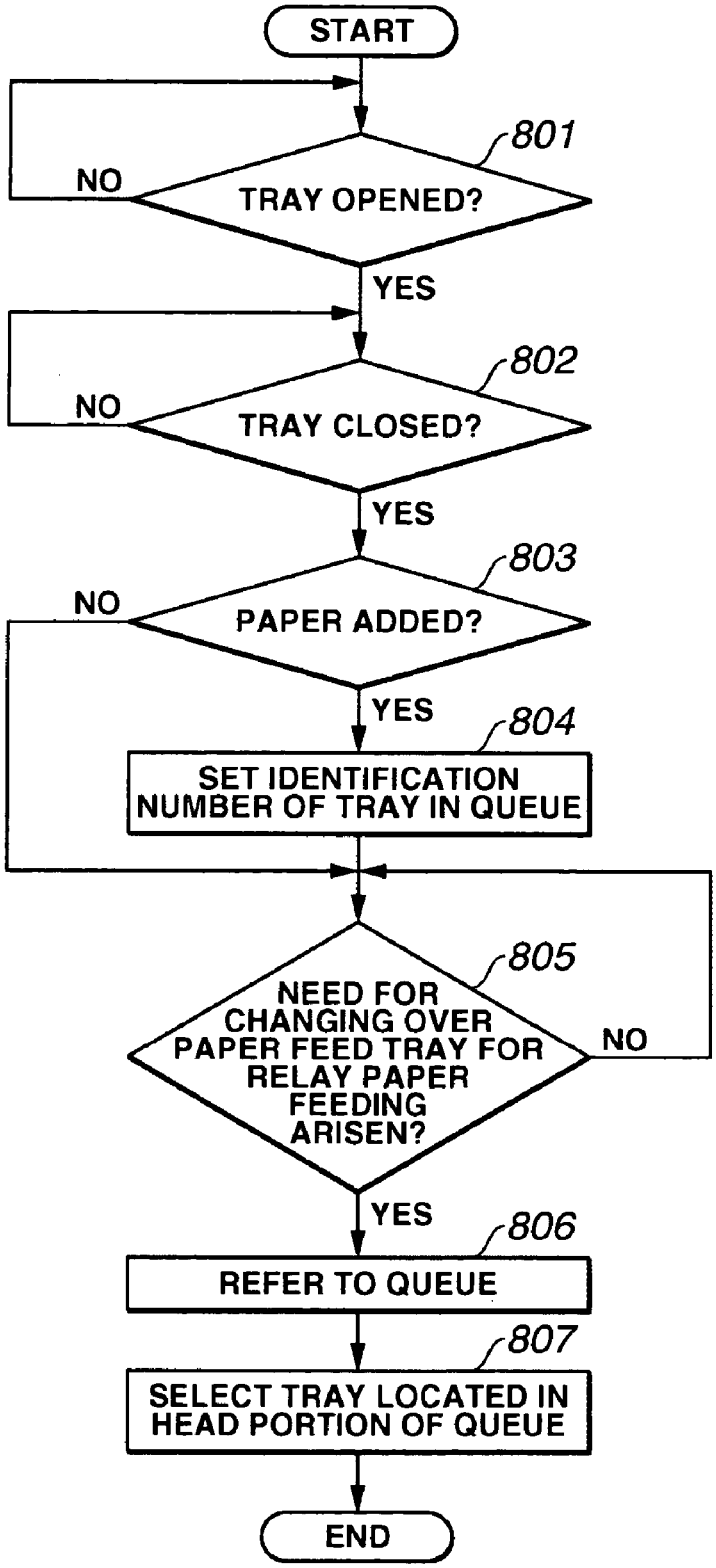
FIG. 8 is a flowchart illustrating the processing of registering the identification number of a paper feed tray in the queue 711.

FIG. 8 is a flowchart illustrating the processing of registering the identification number of the paper feed tray which is opened and closed, and in which paper is added in the queue 711 in the image formation apparatus 700.

Of the plural paper feed trays provided for the image formation apparatus 700, let's take the paper feed tray (paper feed tray C) 760 as an example for explanation.

In the image formation apparatus 700, the paper residual quantities in the paper feed trays which are set are detected by the paper residual quantity detection section in the respective paper feed trays, and are grasped by the controller 720.

And, when the paper feed tray (paper feed tray C) 760 is opened out of the image formation apparatus 700 in which it is set, the tray open/close detection section 761 in the paper feed tray (paper feed tray C) 760 detects that the tray has been opened (YES at step 801).

When the paper feed tray (paper feed tray C) 760 is opened, paper is added in the paper feed tray (paper feed tray C) 760 which is opened.

When the paper feed tray (paper feed tray C) 760 in which paper is added is closed to be set in the image formation apparatus 700, the tray open/close detection section 761 in the paper feed tray (paper feed tray C) 760 detects that the paper feed tray (paper feed tray C) 760 is closed (YES at step 802).

Then, when the controller 720 uses the paper residual quantity detection section 762 to compare the paper residual quantity in the closed paper feed tray (paper feed tray C) 760 with the paper residual quantity in the paper feed tray (paper feed tray C) 760 before being opened, and determines that the paper residual quantity after the closing is larger, the controller 720 determines that paper is added in the paper feed tray (paper feed tray C) 760 (YES at step 803).

When it is determined by the controller 720 that paper is added in the paper feed tray (paper feed tray C) 760 (YES at step 803), the controller 720 registers "C", which is the identification number of the paper feed tray (paper feed tray C) 760, in the queue 711 for selection of a paper feed tray in the memory 710.

The registration in the queue 711 implemented in the memory 710 is performed by first deleting "C", which is the identification number to be registered, from the queue 711, and then registering "C" at the tail of the queue 711 such that, when the relay paper feeding is carried out, the paper feed tray can be selected from the earliest registered one (step 804).

And, when, during printing, out-of-paper is caused, and there arises the need for changing over paper feed tray for the relay paper feeding (YES at step 805), the controller 720 references the queue 711 implemented in the memory 710

(step 806), and selects the paper feed tray of the identification number at the head of the queue 711, excluding the identification number of the paper feed tray which causes the out-of-paper, as the paper feed tray for the subsequent paper feeding (step 807).

And, by the selected paper feed tray, in which paper is added in the earliest time, paper feeding is performed to continue the printing.

By the processing being thus carried out in the image formation apparatus 700, the identification number of the paper feed tray in which paper is added is registered at the tail of the queue 711, and when the relay paper feeding is carried out, the paper feed tray which is registered in the earliest time in the queue 711, and with which the longest time period elapses from the time when the paper is added is selected to continue the printing.

The paper feed tray which is registered at the tail of the queue 711 may be not only the current paper feed tray or the paper feed tray which is just being used for printing, but also an optional paper feed tray which is selected by the user.

A first aspect of the invention provides an image formation apparatus that includes plural paper feed trays, and when there occurs out-of-paper in a paper feed tray during printing, changes over from the paper feed tray to another to continue the printing, which includes a detection section that detects that paper is added in the paper feed tray, a memory that stores the paper feed tray for which the detection section detects that paper is added therein in the sequence of paper being added; and a paper feed tray changing section that, when there occurs out-of-paper in the paper feed tray in operation during printing, selects a paper feed tray in which paper is added in the earliest time among the paper feed trays which are stored in the memory, and changes over the paper feed tray.

A second aspect of the invention provides the image formation apparatus of the first aspect of the invention, in which the detection section may include a first detection section that detects out-of-paper in the paper feed tray, a second detection section that detects that the paper feed tray is opened, a third detection section that detects that the paper feed tray is closed, and a fourth detection section that detects that there exists paper in the paper feed tray, and the detection section detects that paper is added in the paper feed tray, when the first detection section detects out-of-paper in the paper feed tray; thereafter, the second detection section detects that the paper feed tray is opened; the third detection section detects that the paper feed tray is closed; and the fourth detection section detects that there exists paper in the paper feed tray.

A third aspect of the invention provides the image formation apparatus of the first aspect of the invention, in which the detection section may include a first detection section that detects that the paper feed tray is opened, and a second detection section that detects that the paper feed tray is closed, and the detection section detects that paper is added in the paper feed tray, when the first detection section detects that the paper feed tray is opened, and the second detection section detects that the paper feed tray is closed.

A fourth aspect of the invention provides the image formation apparatus of the first aspect of the invention, in which the detection section may include a first detection section that detects residual quantity of paper in the paper feed tray, a second detection section that detects that the paper feed tray is opened, a third detection section that detects that the paper feed tray is closed, and the detection section detects that paper is added in the paper feed tray, when the first detection section detects the residual quantity of paper in the paper feed tray as a first value; the second detection section detects that the paper feed is opened; the third detection section detects that the paper feed tray is closed; the first detection section detects the residual quantity of paper in the paper feed tray as a second value; and the second value is higher than the first value.

A fifth aspect of the invention provides an image formation method for an image formation apparatus that includes plural paper feed trays, and when there occurs out-of-paper in a paper feed tray during printing, changes over from the paper feed tray to another to continue the printing, which include detecting, by a detection section, that paper is added in the paper feed tray, storing, by a memory, paper feed trays for which the detection section detects that paper is added therein in the sequence of paper being added; and when there occurs out-of-paper in a paper feed tray in operation during printing, selecting, by a paper feed tray changing section, the paper feed tray in which paper is added in the earliest time among the paper feed trays which are stored in the memory, and changing over the paper feed tray.

According to the image formation apparatus and the method therefor of the above-mentioned embodiments of the present invention, an image formation apparatus which includes plural paper feed trays, and when there occurs out-of-paper in a paper feed tray during printing, changes over paper feed tray therefrom to another to continue the printing is configured to include a detection section which detects that paper is added in the paper feed tray; a memory which stores the paper feed trays for which the detection section detects that paper is added therein in the sequence of paper being accommodated; and a paper feed tray changeover section which, when, during printing, there occurs out-of-paper in the paper feed tray which is in operation, changes over paper feed tray to continue the printing by selecting the paper feed tray in which paper is added in the earliest time among the paper feed trays which are stored in the memory, thus an effect is provided which, at the time of paper feed tray selection in the relay paper feeding, the paper feed tray which has the earliest date of paper accommodation is selected to continue the printing, which prevents old paper from being left over at the bottom of the paper feed tray.

And, the paper feed tray in which paper is added in the earliest time is selected at the time of paper feed tray changeover in the relay paper feeding, which prevents old paper from being left over in the paper feed tray The present invention is available in an image formation apparatus which includes plural paper feed trays, and when there occurs out-of-paper, can carry out relay paper feeding to continue the printing.

The foregoing description of the embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling other skilled in the art to understand the invention for various embodiments and with the various modifications as are suited to the particular use contemplated. It is intended that the scope of the invention be defined by the following claims and their equivalents.

The entire disclosure of the Japanese Patent Application No. 2006-42498 filed on Feb. 20, 2006 including specification, claims, drawings and abstract is incorporated herein by reference in its entirety.

What is claimed is:

1. An image formation apparatus comprising:

a plurality of trays for feeding paper to the image formation apparatus, each tray of the plurality of trays including a paper-addition-determination portion for determining paper-added-to trays from among the plurality of trays;

a memory including a. queue for registering tray identifications corresponding to the paper-added-to trays in a sequence, the queue having a head portion registering the tray identifications of earlier ones of the paper-added-to trays and a tail portion registering the tray identifications of later ones of the paper-added-to trays; and a tray changing section for changing a first tray with the paper-added-to tray corresponding to the tray identification stored at the head portion, the changing responsive to detection of an out-of-paper condition in the first tray during printing.

2. The image formation apparatus of claim 1, wherein the paper-addition-determination portion includes a tray-open-or-close detection section and determines the paper-added-to trays responsive to the tray being opened and subsequently closed.

3. The image formation apparatus of claim 2, wherein the tray-open-or-close detection section includes:

a tray-open detection section for determining whether the tray is opened; and a tray-close detection section for determining whether the tray is closed.

4. The image formation apparatus of claim 1, wherein the paper-addition-determination portion includes:

a tray-open-or-close detection section;

a tray-out-of-paper detection section for detecting the out-of-paper condition; and a paper detection section for detecting existence of the paper in the tray, wherein the first tray is deleted from the queue responsive to detection of the out-of-paper condition, and wherein the paper-addition-determination portion determines the paper-added-to trays responsive to the tray being opened and subsequently closed and detecting the paper in the tray.

5. The image formation apparatus of claim 1, wherein the paper-addition-determination portion includes:

a tray-open-or-close detection section; and a paper-residual-quantity detection section for detecting an increase in quantity of the paper in the tray compared to a before-opening quantity of the paper in the tray, wherein the paper-addition-determination portion determines the paper-added-to trays responsive to the tray being opened and subsequently closed and detecting the increase in quantity of the paper in the tray.

6. An image formation method being implemented by an image formation apparatus, the image formation apparatus comprising a plurality of trays, a memory, and a tray changing section, each tray of the plurality of trays for feeding paper to the image formation apparatus, each of the plurality of trays for feeding paper including a paper-addition-determination portion, the image formation method comprising:

detecting a paper-added-to tray from among the plurality of trays by the paper-addition-determination portion;

registering tray identifications corresponding to the paper-added-to trays in a queue stored in the memory, the queue having a head portion registering the tray identifications of earlier ones of the paper-added-to trays and a tail portion registering the tray identifications of later ones of the paper-added-to trays; and changing from a currently-in-use tray to the paper-added-to tray corresponding to the tray identification stored at the head portion, the changing performed by the tray changing section responsive to detection of an out-of-paper condition in the currently-in-use tray during printing.

* * * * *